US008484814B2

(12) United States Patent
Parisi

(10) Patent No.: US 8,484,814 B2
(45) Date of Patent: Jul. 16, 2013

(54) THREE POINT RELEASE BUCKLE

(75) Inventor: Brian M. Parisi, Evanston, IL (US)

(73) Assignee: Illinois Tool Works Inc., Glenview, IL (US)

( * ) Notice: Subject to any disclaimer, the term of this patent is extended or adjusted under 35 U.S.C. 154(b) by 344 days.

(21) Appl. No.: 13/011,434

(22) Filed: Jan. 21, 2011

(65) Prior Publication Data

US 2011/0219591 A1 Sep. 15, 2011

Related U.S. Application Data

(60) Provisional application No. 61/312,357, filed on Mar. 10, 2010.

(51) Int. Cl.
*A44B 11/26* (2006.01)

(52) U.S. Cl.
USPC ..... 24/614; 24/625

(58) Field of Classification Search
USPC ..... 24/614, 615, 625, 629, 633
See application file for complete search history.

(56) References Cited

U.S. PATENT DOCUMENTS

| | | | | |
|---|---|---|---|---|
| 5,551,131 | A * | 9/1996 | Anscher | 24/614 |
| 5,774,956 | A * | 7/1998 | French et al. | 24/625 |
| 5,991,985 | A * | 11/1999 | Galbreath | 24/625 |
| 6,138,330 | A * | 10/2000 | Galbreath | 24/625 |
| 6,446,314 | B1 * | 9/2002 | Anscher | 24/614 |
| 6,684,466 | B2 * | 2/2004 | Nishida et al. | 24/615 |
| 7,513,020 | B2 * | 4/2009 | Giampavolo | 24/625 |
| 7,559,126 | B2 * | 7/2009 | Giampavolo | 24/625 |
| 7,681,288 | B1 * | 3/2010 | Giampavolo | 24/615 |
| 7,725,993 | B1 * | 6/2010 | Giampavolo | 24/615 |
| 7,874,049 | B2 * | 1/2011 | Paik | 24/615 |
| 2002/0017011 | A1 * | 2/2002 | Kawamura | 24/615 |
| 2011/0271499 | A1 * | 11/2011 | Parisi | 24/615 |

* cited by examiner

*Primary Examiner* — Robert J Sandy
*Assistant Examiner* — Louis Mercado
(74) *Attorney, Agent, or Firm* — Mark W. Croll; Paul F. Donovan

(57) ABSTRACT

A three point buckle release buckle includes male and female components establishing releasable latch connections at opposite sides of the buckle and a center latch. The center latch is formed by a fixed catch point in the female component and a deflectable bar of the male component. A release button is depressed against the deflectable bar to release the center latch.

16 Claims, 4 Drawing Sheets

THREE POINT RELEASE BUCKLE

CROSS-REFERENCE TO RELATED APPLICATIONS

The present application claims the benefits of U.S. Provisional Application Ser. No. 61/312,357 filed on Mar. 10, 2010.

FIELD OF THE INVENTION

The present invention relates generally to buckles and, more particularly, to so-called three point release buckles having male and female components that automatically engage one with the other for locking and require activation at three distinct points for unlocking.

BACKGROUND OF THE INVENTION

Two-piece buckles that snap together and latch automatically upon adequately inserting a male component into a female component are known and used in a variety of applications. It is known to have a piece of webbing or strap attached to each of the components, and to have one or both buckle components adjustably retained on the strap or webbing. It is also known to have one or both components in fixed locations relative to a strap or web that is sewn or otherwise fixedly secured to the buckle component. Such buckles are known and used for a variety of applications, including outdoor recreational products like backpacks, helmets, life vests and other general equipment; military and police equipment and the like. Two-part buckles are used also on luggage, bags, clothing, etc.

In one known design for buckles of this type, the female component defines a pocket and includes openings or windows on the lateral, opposed sides of the pocket. The male component includes arms having outward protrusions slightly wider than the width of the female component at some positions from the entrance to the window. As the male component is inserted into the female component, the arms are deflected inwardly and thereafter are allowed to rebound outwardly when the protrusions align with the windows in the female component. With the protrusion extending slightly outwardly at the window, the male component is secured within the female component. To release the buckle, the exposed protrusions of the arms are squeezed inwardly through the windows of the female component, allowing the male buckle component to be withdrawn from the female buckle component. The strength of the buckle to resist unintended release when pulling force is applied against either component is determined by the nature of the engagement between the male and female component. The resistance to intended release, or stated another way, the difficulty in unlatching the buckle, is determined by the resistance to bending of the arms upon squeezing the protrusions inwardly from the window, and the resistance of the engaging surfaces to slide past or otherwise disengage from each other.

Buckles of the type described have had success in many applications; however, in some applications and uses for snap together buckles of this type it is desirable that the buckle be somewhat more difficult or complicated to unlatch, so that the buckle does not unlatch unintentionally, and so that individuals other than the user have difficulty in unlatching the buckle. For example, law enforcement officers, military personnel and the like can encounter individuals who are resistant to the orders and commands given them. Physical confrontations can occur. In such a confrontation, the individual may try to unlatch duty belts, equipment or weapons belts worn by the officer or military person. If successful, the individual could use the equipment as a weapon or otherwise entangle or ensnarl the law enforcement officer or military personnel in the loosened equipment. Accordingly, for police officers, military personnel and the like, it can be desirable that the buckle unlatching sequence be difficult to perform except by the individual wearing the equipment.

It is known to provide buckles requiring release not only at the lateral windows along the sides of the buckle, but also at some third location on the buckle. If properly positioned, the user of the buckle can operate the buckle efficiently with one hand, while another person confronting the wearer would have difficulty operating the buckle, even with two hands. A known three point release buckle is disclosed in U.S. Pat. No. 6,684,466.

Improvements in three-point release buckles are desirable so that the buckles are secure in use, resistant to release by persons other than the user, yet easily operated by the user to release when necessary.

SUMMARY OF THE INVENTION

The present invention provides a three-point release buckle having lateral release points at the sides of the buckle and a third release point on the external surface of the buckle positioned so that the buckle can be operated by an individual using three fingers of one hand.

In one aspect of a form thereof a three-point release buckle is provided with a male component including first and second latch arms and a deflectable center bar between the latch arms, and a female component defining a pocket for receiving the first and second latch arms and center bar. First and second releasable latch connections include the first and second arms in the pocket along opposite sides of the buckle. A third releasable latch connection includes a fixed catch point in the female component engaging the center bar when the buckle is latched and a deflectable release button in the female component operable against the center bar to move the center bar away from the fixed catch point when the buckle is being unlatched. Legs extending from said release button project into said pocket and receive a portion of said center bar therebetween.

In another aspect of a form thereof, a buckle is provided with a male component having latch arms and a deflectable center bar and a female component defining a pocket for receiving the latch arms and center bar. First and second connections are formed between the latch arms and the female component with the buckle in a latched condition. A fixed catch point in the female component is provided for engaging the center bar in a third connection with the buckle in a latched condition. A release button in the female component includes legs extending into the pocket operable against the deflectable center bar when releasing the third connection.

In a further aspect of a form thereof, a buckle is provided with a male component having latch arms and a deflectable center bar with a distal front panel and a female component defining a pocket for receiving the latch arms and the center bar. A fixed catch point is provided in the pocket. Lateral connections are made between the latch arms and the female component with the buckle in a latched condition. A central connection of the center bar to the fixed catch point is made with the buckle in a latched condition. A release button in the female component includes legs operable for deflecting the center bar to release the central connection.

An advantage of one aspect of an embodiment of the buckle disclosed herein is providing a buckle that operates smoothly for release by the user, but is difficult to operate by someone other than the user.

Another advantage of another aspect of an embodiment of the buckle disclosed herein is providing a buckle that is both strong and secure.

A further advantage of a further aspect of an embodiment of the buckle disclosed herein is providing a buckle that is resistant to damage from misuse of the buckle.

Other features and advantages of the invention will become apparent to those skilled in the art upon review of the following detailed description, claims and drawings in which like numerals are used to designate like features.

Figure 1:
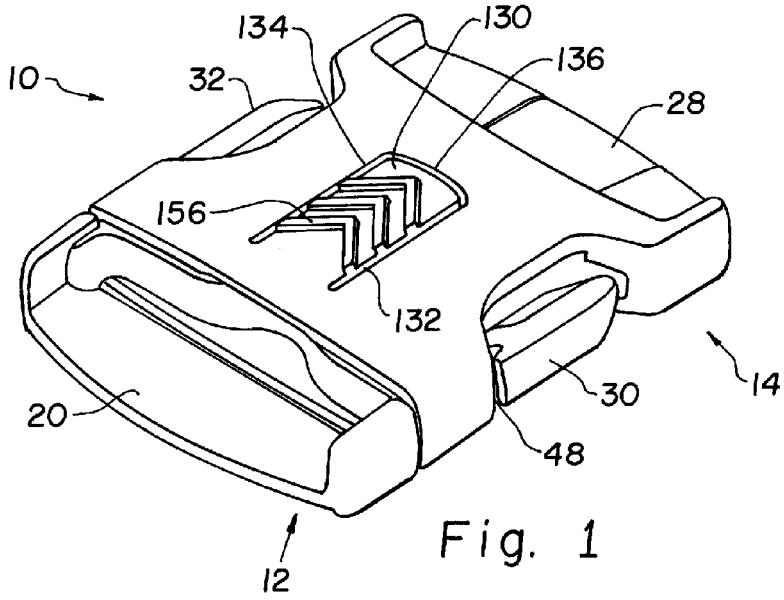
FIG. 1 is a perspective view of a three point release buckle in a connected or latched condition with the buckle components connected to one another.
Figure 2:
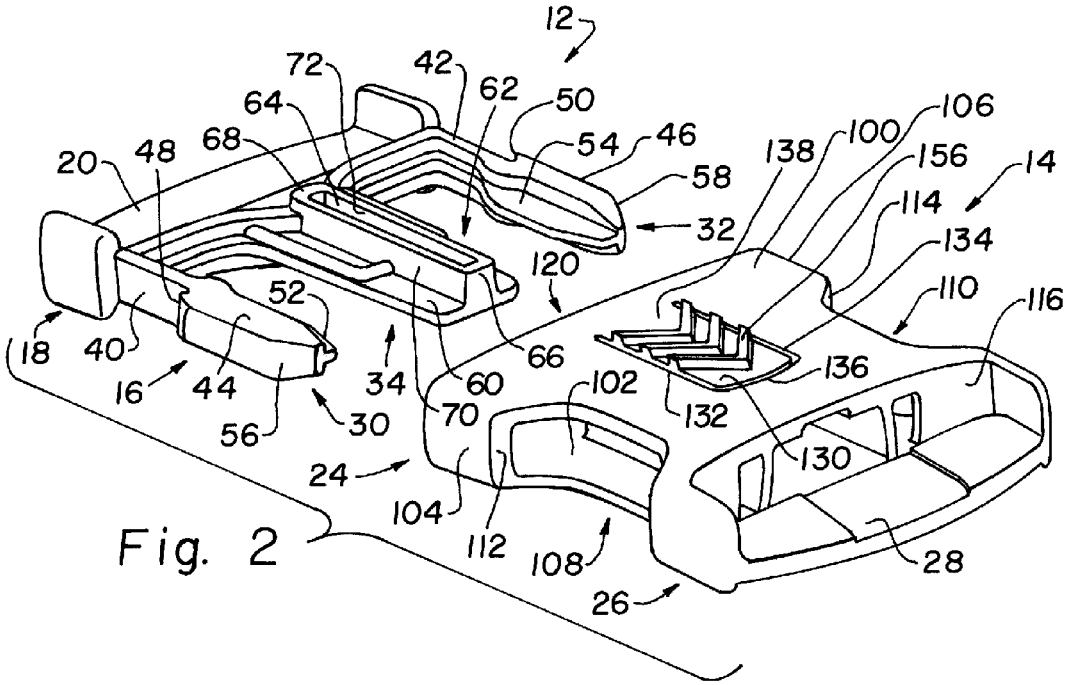
FIG. 2 is a perspective view of the buckle shown in FIG. 1 in an unlatched condition, with the buckle components disconnected from one another.
Figure 3:
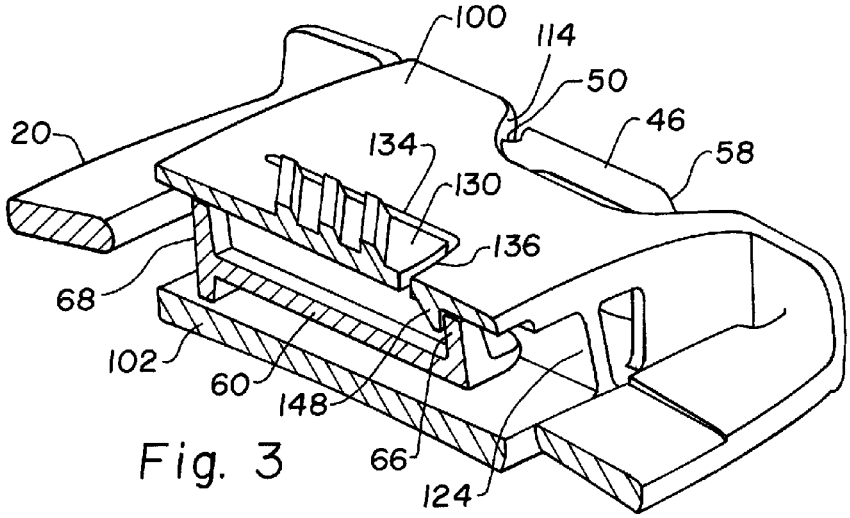
FIG. 3 is a cross-sectional view of the buckle shown in FIG. 1.
Figure 4:
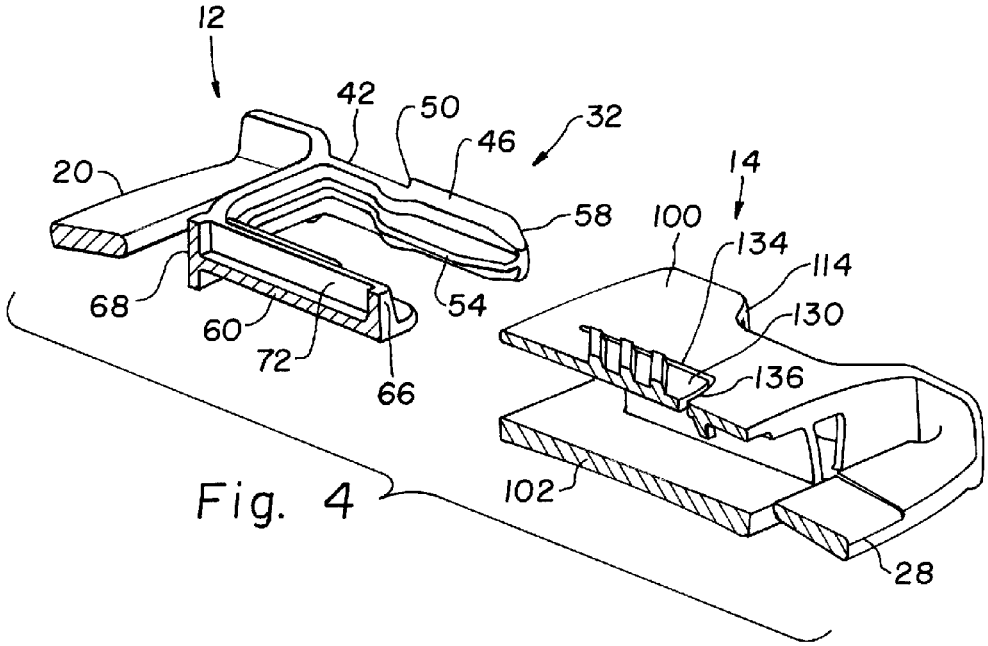
FIG. 4 is a cross-sectional view of the buckle as shown in FIG. 2.
Figure 5:
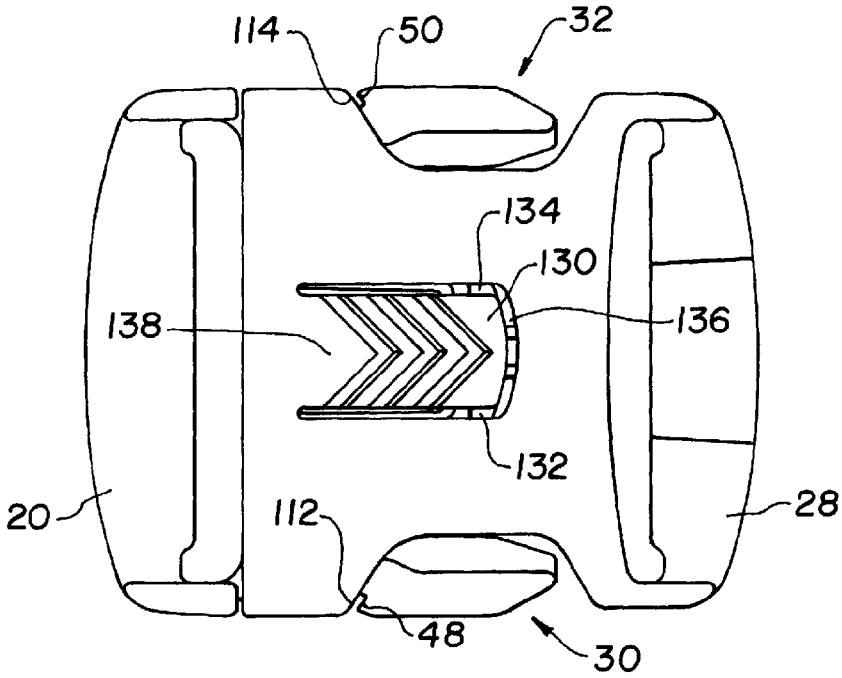
FIG. 5 is a top view of the buckle in a latched condition.
Figure 6:
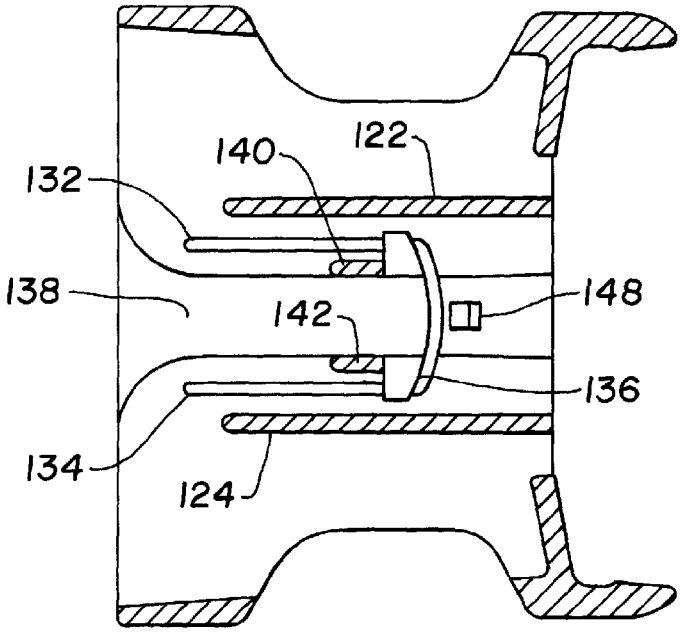
FIG. 6 is cross-sectional view of the female component for the buckle.
Figure 7:
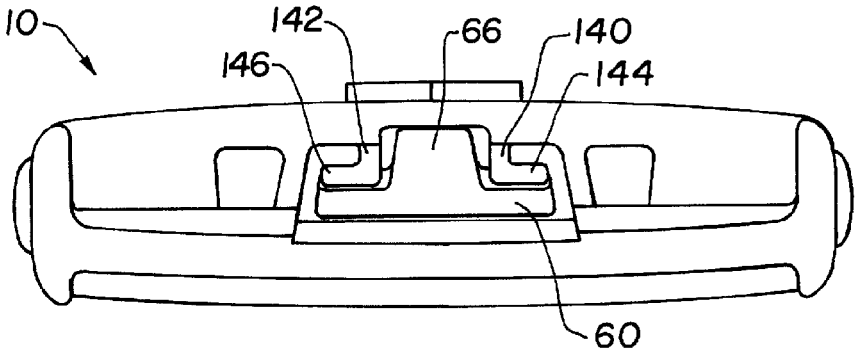
FIG. 7 is an end view of the latched buckle shown in FIG. 1.
Figure 8:
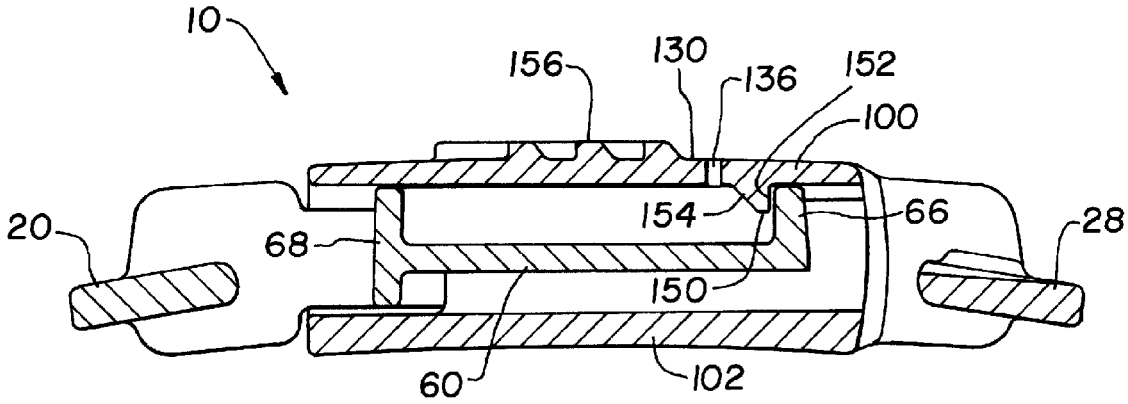
FIG. 8 is another cross-sectional view of the buckle.
Figure 9:
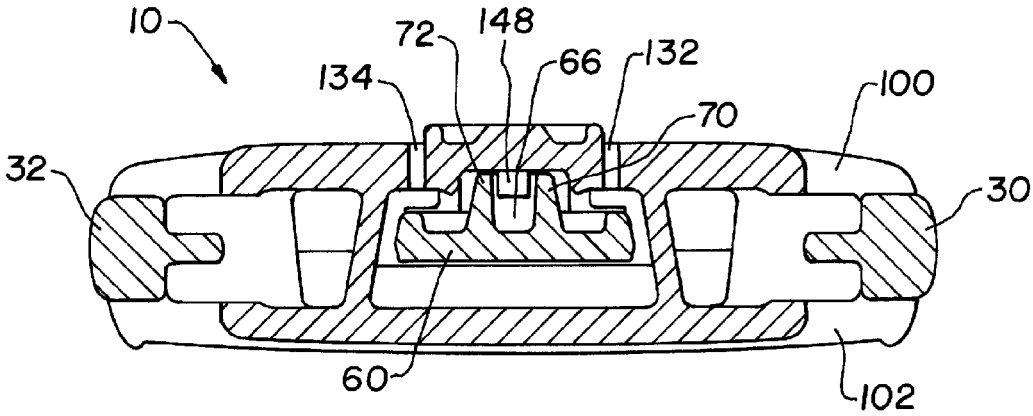
FIG. 9 is still another cross-sectional view of the buckle.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more particularly to the drawings and to FIG. 1 in particular, an embodiment of a three point release buckle 10 is shown. Buckle 10 includes a male component 12 and a female component 14. Male component 12 includes a latching structure 16 and a web attachment structure 18 including a web bar 20. Female component 14 includes a receiving body or pocket 24 and a web attachment structure 26 including a web bar 28. Latching structure 16 of male component 12 is inserted into and received by pocket 24 of female component 14, whereby buckle 10 is latched. Male component 12 and female component 14 can be made as individual monolithic structures of plastic formed by injection molding processes, or the like.

Straps or webs (not shown) can be attached to web bars 20 and 28 in known manner so that buckle 10 can be used to secure together opposite ends of a single web or to connect ends of separate webs. Alternatively, one or the other of male component 12 and female component 14, or both male component 12 and female component 14 can be attached directly to an item or article other than a strap or web. In the exemplary embodiment shown, web bars 20 and 28 can be used in a manner in which a strap or webbing encircles the bar, with the strap or webbing secured to itself by stitching, rivets or other types of fasteners, or adhesive or other type of attachment, to secure the strap or webbing in a fixed condition on the bar. Those skilled in the art will readily understand that other types of sliding clips or locks can be used with a strap or webbing encircling a web bar so that the end of the strap or webbing remains adjustable relative to the buckle. Further, rather than a single web bar, either or both of male component 12 and female component 14 can include multiple bars so that the strap or webbing can engage therewith in a serpentine pattern whereby the male component and/or the female component is securely positioned relative to the strap or webbing, but may be adjusted along the length of the strap or webbing, in known manner. The arrangement by which one or both of male component 12 and female component 14 are attached to articles, including a strap or webbing is not a limiting factor with respect to the application or use of the three point release buckle disclosed herein.

It should be understood that buckle 10 can be used in different orientations, vertically, horizontally and at various angles. To facilitate the explanation and description of the features of buckle 10, terms such as top, bottom, upper, lower, side, lateral and the like may be used with reference to the common orientation of the buckle as shown in the drawings. However the use of such terms describing orientation should not be viewed as limiting either on the use of the buckle disclosed herein, or the breadth of the claims to follow.

Latching structure 16 of male component 12 includes first and second lateral latch arms 30, 32 and an intermediate or center bar 34 projecting outwardly from attachment structure 18 of male component 12. Center bar 34 is positioned between and spaced from latch arms 30, 32. In the exemplary embodiment, center bar 34 is centered between lateral latch arms 30 and 32.

Latch arms 30, 32 are mirroring structures of one another and extend into female component 14 when buckle 10 is latched. Proximal ends of arms 30, 32 define thinner flex segments 40, 42 respectively, and distal ends of arms 30, 32 define enlarged or bulbous portions 44, 46 respectively. Bulbous portions 44, 46 project laterally both inwardly and outwardly from axes defined by the non-deflected conditions of flex segments 40, 42, respectively. Upon lateral force exerted against bulbous portions 44, 46 arms 30, 32 deflect or bend along flex segments 40, 42, respectively, proximate attachment structure 18.

On the outer sides thereof, bulbous portions 44, 46 define catch ledges 48, 50 respectively for engaging female component 14. In the exemplary embodiment shown, catch ledges 48, 50 angle outwardly and rearward toward the proximal ends of arms 30, 32. Further with respect to the exemplary embodiment, on the inner sides thereof, bulbous portions 44, 46 define thinner, guide plates 52, 54 which can be used with cooperating structure within female component 14 for directing relative movement of the male and female components with respect to one another and/or for stiffening distal portions of arms 30, 32.

Latch arms 30, 32 of the exemplary embodiment are provided with angular distal ends 56, 58 at the leading ends of bulbous portions 44, 46 to facilitate initial alignment of male component 12 with female component 14 for latching buckle 10. Distal ends 56, 58 guide latch arms 30, 32 into receiving body pocket 24.

Center bar 34 of the exemplary embodiment shown is a substantially rectangular structure which extends into female component 14 when buckle 10 is latched. Center bar 34 includes a base 60 and an open-topped box 62 defining an elongated cavity 64 therein. Box 62 includes a front panel 66 at a distal end of center bar 34, a back 68 and spaced sides 70, 72 extending upwardly from base 60. Sides 70, 72 extend proximally from front panel 66 toward and to back 68. Portions of base 60 extend laterally outwardly beyond the outer bottom edges of sides 70, 72

Receiving body pocket 24 includes opposed, spaced upper and lower plates 100, 102 and sides 104, 106 between plates 100, 102 along the lateral edges of the plates. Sides 104, 106 define inset openings or windows 108, 110, respectively, which are elongated in configuration. Windows 108, 110 are sized and positioned to receive the laterally outwardly projecting segments of bulbous portions 44, 46 respectively when male component 12 is fully inserted into female component 14. Windows 108, 110 are defined partly by latch surfaces 112, 114 at edges thereof for engaging catch ledges 48, 50 of male component 12 when the buckle is latched. Latch surfaces 112, 114 can be angularly oriented complementary to the angles of catch ledges 48, 50 to provide secure engagement inhibiting unintentional unlatching of buckle 10.

Upper and lower plates 100, 102 and sides 104, 106 define an entrance opening 120 leading into the pocket-like structure of receiving body 24. Entrance opening 120 defines the entrance for insertion of the distal ends of latch arms 30, 32 and center bar 34 when buckle 10 is being latched. The inner surfaces of upper and lower plates 100, 102 can define ridges, channels or other configurations for guiding and directing the insertion of male component 12 into female component 14. Accordingly, ridges 122, 124 extend along the inner surface of upper plate 100.

A deflectable springing release button 130 is provided on upper plate 100 and is defined by spaced longitudinal slits, which may be longitudinal linear slit 132 and 134 and a transverse slit 136 interconnecting longitudinal slits 132, 134 at the rearward or proximal ends thereof relative to web attachment structure 26. Accordingly, spring release button 130 is a cantilevered-like structure maintaining a contiguous connection with upper plate 100 along a distal region 138 of spring release button 130.

On the inner surface thereof, spring release button 130 defines inwardly projecting tabs that include spaced legs 140, 142 having feet 144, 146 overlying the portions of base 60 laterally outward of box 62 when buckle 10 is latched. Legs 140, 142 are spaced a sufficient distance to receive box 62 slidingly therebetween. Accordingly, downward force exerted on spring release button 130 is transferred by legs 140, 142 and feet 144, 146 to center bar 34 to cause downward deflection of center bar 34. The spatial relationships between legs 140, 142; feet 144, 146; base 60 and box 62 prevent insertion of male component 12 into female component 14 in an inverted orientation in that base 60 is wider than the spacing between legs 140, 142 and must pass beneath feet 144, 146 while box 62 passes between the legs. Legs 140, 142 and feet 144, 146 also limit the maximum inward deflection of release button 130. Further, if feet 144, 146 project laterally from legs 140, 142 a distance greater than the spacing between longitudinal slots 132, 134 the feet will restrict the maximum outward deflection of release button 130 as well. Accordingly, damage that may result from excessive inward or outward deflection of release button 130 is inhibited.

On the opposite side of transverse slit 136 from release button 130, upper plate 100 defines an inwardly projecting latch hook or catch point 148 that cooperates with center bar 34, and more specifically with front panel 66 of box 62 to provide a third latch area in addition to the latch areas provided by latch arms 30, 32 engaging windows 108, 110. Catch point 148 is in fixed position in female component 14 and projects into pocket 24. catch point 148 includes a horizontal segment 150, a vertical lip 152 and an angular surface 154 exposed to entrance opening 120 whereby, upon insertion of male component 12 into female component 14, front panel 66 of male component 12 engages and rides under catch point 148 due to downward deflection of center bar 34. As front panel 66 passes completely beneath horizontal segment 150, center bar 34 rebounds to a non-deflected position wherein the inner surface of front panel 66 engages vertical lip 152 of catch point 148.

The exposed outer surface of release button 130 between longitudinal slits 132, 134 can be provided with knurls or ridges 156 to facilitate pushing there against when unlatching the buckle. Various other surface configurations or treatments can be used to inhibit slipping when a user presses a finger against release button 130 while unlatching buckle 10.

In using buckle 10, the buckle is latched by inserting male component 12 into female component 14. Specifically, latching structure 16 is aligned with receiving body pocket 24, and distal ends of latch arms 30, 32 are moved into entrance opening 120. Angular distal ends 56, 58 of latch arms 30, 32 begin first orientation of male component 12 relative to female component 14. As center bar 34 enters entrance opening 120 and proceeds into pocket 24, base 60 passes beneath feet 144, 146 and box 62 slides between legs 140, 142, further aligning male component 12 with female component 14. If male component 12 is positioned inverted from the desired orientation, as center bar 34 encounters legs 140, 142 and feet 144, 146 further advancement is inhibited in that base 60 is wider than the space between legs 140, 142 and can not pass therebetween. Final advancement of male component 12 into female component 14 can occur only if base 60 is positioned to slide beneath feet 144, 146 and box 62 is positioned to slide between legs 140, 142.

The inside width of receiving body pocket 24 is of slightly narrower dimension than the non-deflected width of latch arms 30, 32; at least upstream of windows 108, 110. Accordingly, the latch arms are deflected inwardly until bulbous portions 44, 46 progress into receiving body pocket windows 108, 110. When aligned with the windows, bulbous portions 44, 46 rebound outwardly such that catch ledges 48, 50 thereof engage latch surfaces 112, 114, respectively. The angular orientations of catch ledges 48, 50 and latch surfaces 112, 114 inhibit unintended unlatching if the male and female components are pulled in opposite directions.

At the same time that the bulbous portions 44, 46 are moving into windows 108, 110; front panel 66 encounters angular surface 154, and passes beneath and beyond catch point 148 until front panel 66 has progressed beyond vertical lip 152. The buckle is then latched at three locations. First and second lateral latch connections are provided along the sides of the buckle whereat catch ledges 48, 50 engage latch surfaces 112, 114. A third or central latch connection between male component 12 and female component 14 is established by catch point 148 engaging front panel 66. The latched condition of buckle 10 can be seen In FIGS. 1, 3, 5, 7, 8 and 9.

To unlatch buckle 10, male component 12 is removed from female component 14 by simultaneously disconnecting the first and second lateral latch connections established by catch ledges 48, 50 engaging latch surfaces 112, 114; and also disengaging the central latch connection provided by catch point 148 against front panel 66. A user of the buckle simultaneously squeezes the sides of the buckle to deflect latch arms 30, 32 inwardly to disengage catch ledges 48, 50 from latch surfaces 112, 114, while at the same time using a finger or fingers to apply pressure against the outer surface of upper plate 100 in the area between longitudinal slits 132, 134, specifically against knurls or ridges 156. Pressure applied on the outer surface of female component 14 in the area between longitudinal slits 132, 134 is transferred through legs 140, 142 and feet 144, 146 to center bar 34, causing downward deflection of center bar 34. The upper edge of front panel 66 is moved to a relative position lower than horizontal segment 150 so that front panel 66 can pass beneath catch point 148 as male component 12 is withdrawn from female component 14. Disengaging the three latch connections simultaneously allows male component 12 to be pulled from female component 14. If only one or two of the latch connections are operated, the buckle will not disengage. All three must be operated simultaneously to disengage the latch.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A three-point release buckle, comprising:

a male component including first and second latch arms and a deflectable center bar between the latch arms;

a female component defining a pocket for receiving said first and second latch arms and said center bar, said female component further defining windows along sides thereof, and said first and second latch arms having catch ledges engaging edge surfaces of said windows with said buckle in a latched condition;

first and second releasable latch connections of said first and second arms in said pocket along opposite sides of said buckle;

a third releasable latch connection including a fixed catch point in said female component engaging said center bar when said buckle is latched and a deflectable release button in said female component operable to move said center bar away from said fixed catch point when said buckle is being unlatched; and legs extending from said release button and projecting into said pocket and receiving a portion of said center bar therebetween.

2. The buckle of claim 1, said male and female components including cooperative structures limiting orientation of said male component when inserted into said female component.

3. The buckle of claim 2, said center bar including a base and a front panel projecting from said base at a distal end of said center bar.

4. The buckle of claim 3, said center bar defining a box including sides in spaced relation to one another and extending proximally from said front panel.

5. The buckle of claim 1, said male and female components having cooperating structure orienting said components for insertion of said male component in said female component.

6. The buckle of claim 5, said center bar including a base and a box projecting from said base, said box having a front panel at a distal end of said center bar and sides extending proximally from said front panel, and said base extending laterally outwardly of said sides.

7. The buckle of claim 6, said legs in said pocket spaced for receiving said box therebetween.

8. The buckle of claim 7, including feet at distal ends of said legs confronting said base outwardly of said sides.

9. A buckle comprising:

a male component having latch arms and a deflectable center bar;

a female component defining a pocket for receiving said latch arms and said center bar;

first and second connections between said latch arms and said female component with said buckle in a latched condition;

a fixed catch point in said female component for engaging said center bar in a third connection with said buckle in a latched condition; and a release button in said female component including legs extending into said pocket and said legs operable against said deflectable center bar when releasing said third connection.

10. The buckle of claim 9, said center bar defining a box having a front panel at a distal end of said center bar, and sides extending proximally from said front panel.

11. The buckle of claim 10, said legs receiving said box therebetween.

12. The buckle of claim 11, said legs having feet, and said center bar having a base for sliding engagement with said feet.

13. The buckle of claim 12, said base extending laterally of said sides.

14. A buckle comprising:

a male component having latch arms and a deflectable center bar with a distal front panel;

a female component defining a pocket for receiving said latch arms and said center bar;

a fixed catch point in said pocket;

lateral connections between said latch arms and said female component with said buckle in a latched condition;

a central connection of said center bar to said fixed catch point with said buckle in a latched condition; and a release button in said female component including legs operable for deflecting said center bar to release said central connection, said female component having spaced longitudinal linear slits and a transverse slit therebetween defining said release button, said legs having feet engaging said center bar, and said feet extending laterally of said longitudinal linear slits.

15. The buckle of claim 14, said legs receiving a portion of said center bar therebetween.

16. The buckle of claim 14, said feet being configured to be in sliding engagement with said center bar while latching said buckle.

* * * * *